US005302042A

United States Patent [19]

Ackermann

[11] Patent Number: 5,302,042

[45] Date of Patent: Apr. 12, 1994

[54] ANTI-BACKOFF LIPSTICK CONTAINER

[75] Inventor: Walter T. Ackermann, Watertown, Conn.

[73] Assignee: Risdon Corporation, Naugatuck, Conn.

[21] Appl. No.: 985,121

[22] Filed: Dec. 3, 1992

[51] Int. Cl.[5] ..... A45D 40/12; A45D 40/06

[52] U.S. Cl. ..... 401/74; 401/78; 401/87

[58] Field of Search ..... 401/74, 78, 87, 84, 401/83

[56] References Cited

U.S. PATENT DOCUMENTS

| | | | |
|---|---|---|---|
| 1,835,580 | 12/1931 | Wild | 401/78 |
| 2,352,448 | 6/1944 | Reichenbach | 401/78 |
| 3,124,245 | 3/1964 | Hopgood | 401/78 |

FOREIGN PATENT DOCUMENTS

| | | | |
|---|---|---|---|
| 671829 | 12/1929 | France | 401/74 |
| 1040240 | 10/1953 | France | 401/74 |
| 410652 | 4/1945 | Italy | 401/78 |

*Primary Examiner*—Steven A. Bratlie
*Attorney, Agent, or Firm*—Dallett Hoopes

[57] ABSTRACT

A screw-type propel/repel lipstick has a stepped profile along one edge of the slot in the sleeve of a lipstick. The stepped edge is on the lower end of the spiral opening in the cam where the opening overlies the slot. Preferably, the cup lug has a point in its cross section pointing down toward the stepped side of the slot. When the pomade starts to backoff, the point of the lug catches on the stepped profile.

4 Claims, 1 Drawing Sheet

ANTI-BACKOFF LIPSTICK CONTAINER

BACKGROUND OF THE INVENTION

1. Field of the Invention

This invention relates to a lipstick container. More specifically, the invention relates to a lipstick container having means to block the unwanted retraction or "backoff" of the pomade into the container when the lipstick is in use.

2. Description of Related Art including Information Disclosed under §§1.97 to 1.99

The prior art is replete with lipstick containers having so-called screw type repel/propel means for moving the pomade outward and inward. Generally these comprise a tubular sleeve, or inner, having a longitudinal slot and a pomade-filled cup reciprocable in the sleeve and having lugs extending through the slot. Finally, a tubular cam surrounds the sleeve and has a spiral opening about its inside, the opening receiving the ends of the lugs. When the user turns the sleeve relative to the cam, the pomade cup moves up and down.

So that the user does not have to turn the cam an excessive number of times, it is desired to have the spiral opening in the cam of a relatively steep pitch. Thus, in turning the cam only one rotation relative to the sleeve, the user may drive the pomade all the way up or retract it all the way.

The steep pitch of the cam creates a problem. In some cases, as the user grasps the container and presses the pomade to her lips, the steepness of the spiral opening has forced the rotation of the sleeve and permitted the depression or "backing off" of the pomade back toward its retracted position. This is undesirable for obvious reasons.

SUMMARY OF THE INVENTION

The invention in a screw-type propel/repel lipstick is the provision of a stepped profile along one edge of the slot in the inner sleeve. The stepped edge is adjacent the lower end of the spiral opening in the cam where the opening overlies the slot. Preferably, the cup lug has a point in its cross section pointing down toward the stepped side of the slot. When the pomade starts to backoff, the point of the lug catches on the stepped profile.

BRIEF DESCRIPTION OF THE DRAWINGS

Further objects and features of the invention will be apparent to those skilled in the art from a study of the following specification and the drawings, all of which disclose a non-limiting embodiment of the invention. In the drawings.

DESCRIPTION OF THE PREFERRED EMBODIMENT

Figure 1:
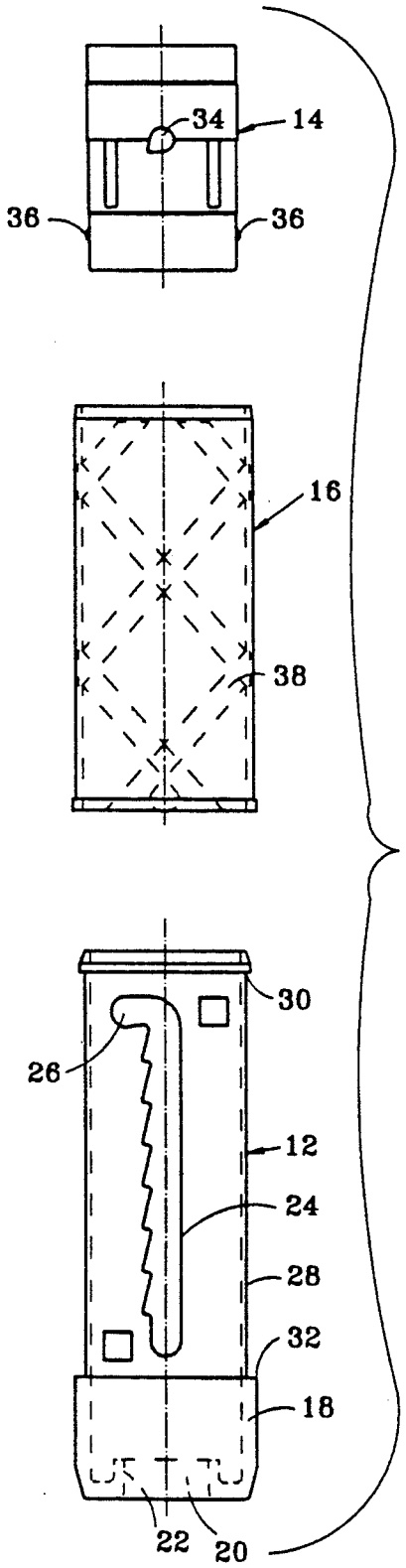
FIG. 1 is an exploded view showing the primary parts of a container embodying the invention.
Figure 2:
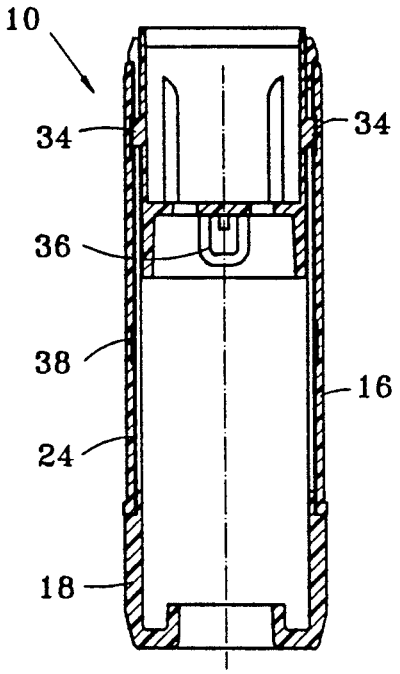
FIG. 2 is a centerline section of an assembled container embodying the invention.

A lipstick container embodying the invention is shown assembled in FIG. 2 and is generally designated 10. It comprises (FIG. 1) a sleeve 12, a pomade-containing cup 14 reciprocable within the sleeve and a tubular cam 16 surrounding the sleeve.

More specifically, the sleeve, which may be thickened at its base 18 and formed with a return 20 and an opening 22, is provided with longitudinal slots 24 on opposite sides (FIG. 2). The slots may each have a conventional lateral lock 26 (FIG. 1) at its upper end to hold the pomade cup fully extended for reasons which will appear. A central portion of the sleeve is reduced at 28 to provide shoulders 30 and 32.

Figure 4A:
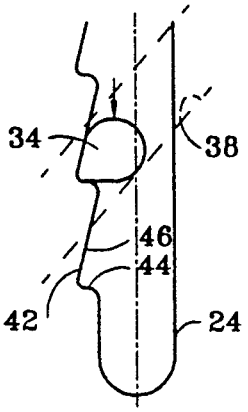
FIGS. 4*a*, 4*b* and 4*c* are greatly enlarged fragmentary views of the slot in the sleeve and a lug operating therewith. Shown in phantom in each is the overlying—that is, outward—portion of the spiral opening in the cam. Arrows indicate the relative movement of the lug and the adjacent tubular cam.

The pomade cup 14 is provided with outward lugs 34 which are both narrower than the minimum width of the slot so that the cup can rotate within a short arc of travel as described herebelow in connection with FIGS. 4*a*, *b* and *c*. The cup may be provided with conventional frictional nibs 36 to engage the inside of the sleeve 12. In assembly, the cup 14 (FIG. 2) is inserted in the sleeve 12 with its lugs 34 extending through the slots 24.

The cam 16 is provided on its inside surface with spiral openings 38 in the form of steeply pitched shallow grooves, as shown. The openings are parallel and spaced so that one is precisely opposite the other across the cam. In assembly, the cam is pushed down over the bevelled upper end of the sleeve and comes to rest between the shoulders 30, 32 on the sleeve whereon it is freely rotatable. The lugs 34 are received into the spiral openings 38.

Figure 3:
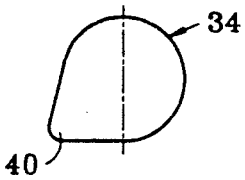
FIG. 3 is a greatly enlarged view of the end of a lug as used in the invention: It has been turned 90° to show the action of the lugs in the slots.

Attention is now focused on the profile of one of the lugs 34. Three-quarters of the lug is essentially cylindrical. Its lower quadrant edge (FIG. 3) is pointed as at 40 for reasons which will appear. The lug 34 thus has the appearance in profile of a teardrop lying on its side. This shape is the same for the length of each lug.

Figure 4B:
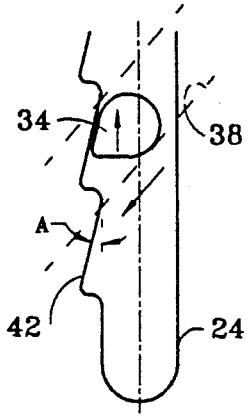
Figure 4C:
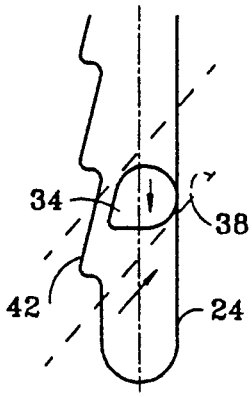

FIGS. 4*a*, 4*b* and 4*c* show the slot profile and the action of the lug 34 as the cam is stationary or turned relative to the sleeve.

As stated in the summary of the invention, at least one of the slots 24 has a stepped profile 42. Each step comprises a relatively horizontal tread 44 (FIG. 4*a*) and a relatively long steep inclined riser 46. The risers slant down from the vertical to the inside of the adjacent tread 44 at relatively small acute angle A (FIG. 4*b*) to the vertical. The steps are-all preferably the same and extend from adjacent the lower end of the slot 24 to the upper end but only on one side of the slot.

The side of the slot on which the steps are formed is the side toward which the overlying portion of the spiral opening 38, as indicated in phantom in FIG. 4*a*, for instance, inclines downwardly.

The operation of a lug will now be described. In FIG. 4*a* with the pomade cup partly elevated and the pomade in use against a woman's lips, the downward force (arrow) causes the lug to engage the lower margin of the opening 38. This margin is inclined and as the lug moves downward under pressure it is guided by the margin so that the cup rotates and the point 40 of the lug nestles into the inside juncture of the tread and riser as shown.

FIG. 4*b* indicates the action of a lug when the tubular cam is turned relative to the sleeve in a direction which raises the pomade. It can be seen that when the tubular cam is turned relative to the sleeve in a direction as indicated by the arrow, the spiral opening 38, in effect, moves upward along the slot, carrying the lug 34 with it. As it moves upward, the lug 34 rides against the stepped profile so that the point 36 traces the profile of the steps. This produces a slight "ratcheting" feel, but is not objectionable.

When the pomade is extended for use, it is stopped where the lug 34 is short of the upper end of the slot 24. The user will prefer, when the pomade is new, to not extend it all the way because a longer extension will not give as much control in applying the pomade to the lips. After the advancement is stopped, the lug 34 moves in accordance with FIG. 4*a* as described to block "backoff".

Finally, as shown in FIG. 4*c*, when it is desired to retract the pomade, the cam is rotated relative to the sleeve as shown by the arrow along incline 38. This movement causes the exposed part of the spiral opening 38 adjacent the lug 34 to move downwardly in the slot as indicated by the arrow on the lug 34.

Because the movement of the cam is in the direction of the inclined arrow, the opening 38 drives the lug against the smooth side of the slot 24 and brings the pomade down smoothly, and the steps 44 do not interfere with the downward movement of the lug.

By virtue of the structure described, it is possible to apply pomade using whatever force is necessary against the lips and still not have the pomade tend to "backoff" into the container. This is true despite the steep pitch on the spiral opening 38. At the same time, the efficient advancement or retraction of the pomade is not compromised.

The invention having been disclosed in only one of its embodiments is not limited to the embodiment shown but, instead, may take the form of variations not disclosed here. The invention, therefore, should be thought of as having the scope of the following language extended by any broadening of the right to exclude deemed appropriate under the Doctrine of Equivalents.

What is claimed is:

1. A cosmetic container comprising:

a. a tubular sleeve having a longitudinal slot therein, the slot having a stepped profile along one edge thereof, the steps having relatively short, generally horizontal treads and relatively long risers, the risers slanting down from the vertical to the inside of the adjacent tread at a relatively small acute angle to the vertical, b. a pomade-containing cup reciprocable inside the sleeve, the cup having a sidewall formed with an outward lug thereon, the lug fitting into and through the slot, the lug having a generally pointed lower corner toward the stepped profile of the slot, the lug being of narrower width than the minimum width of the slot, c. a tubular cam having a steep spiral opening thereabout, the cam circumposing the sleeve and the opening receiving the lug, the spiral opening having smooth sides and being inclined in a direction so that where it overlies the slot it inclines downward toward the stepped profile, whereby turning the cam relative to the sleeve to retract the pomade will move the lug away from the stepped profile and lower the cup, and turning the cam to advance the pomade will move the lug up to ratchet along the stepped margin to raise the cup, the spiral opening normally guiding the lug down toward the stepped profile so that the pointed lower corner engages in the juncture of a riser at the inside of the tread to provide anti-backoff when downward pressure is put on the pomade during use.

2. A cosmetic container as claimed in claim 1 wherein the sleeve has a pair of slots diametrically opposed across the sleeve, and a pair of parallel spiral openings, and the cup has diametrically opposed outward lugs, the lugs both being received by the respective slots and the respective spiral openings.

3. A cosmetic container comprising:

a. a tubular sleeve having a longitudinal slot therein, the slot having a stepped profile along one edge thereof, b. a pomade-containing cup reciprocable inside the sleeve, the cup having a sidewall formed with an outward lug thereon, the lug fitting into and through the slot, the lug having a generally pointed lower corner toward the stepped profile of the slot the lug being of narrower width than the minimum width of the slot, c. a tubular cam having a steep spiral opening thereabout, the cam circumposing the sleeve and the opening receiving the lug, the spiral opening having smooth sides and being inclined in a direction so that where it overlies the slot it inclines downward toward the stepped profile, whereby turning the cam relative to the sleeve to retract the pomade will move the lug away from the stepped profile and lower the cup, and turning the cam to advance the pomade will move the lug up along the stepped margin to raise the cup, the spiral opening normally guiding the lug down toward the stepped profile to provide anti-backoff when downward pressure is put on the pomade during use.

4. A cosmetic container as claimed in claim 3 wherein the sleeve has a pair of slots diametrically opposed across the sleeve, and a pair of parallel spiral openings, and the cup has diametrically opposed outward lugs, the lugs both being received by the respective slots and the respective spiral openings.

* * * * *